US010044138B2

(12) United States Patent
Chikusa et al.

(10) Patent No.: US 10,044,138 B2
(45) Date of Patent: Aug. 7, 2018

(54) CONNECTOR WITH LINEARLY MOVABLE OPERATING MEMBER THAT IS MOVABLE OPTIONALLY IN OPPOSITE FIRST AND SECOND MOVING DIRECTIONS FOR CONNECTING THE CONNECTOR TO A MATING CONNECTOR

(71) Applicant: Sumitomo Wiring Systems, Ltd., Yokkaichi, Mie (JP)

(72) Inventors: Takahiro Chikusa, Mie (JP); Shinji Iihoshi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/608,180

(22) Filed: May 30, 2017

(65) Prior Publication Data

US 2017/0346223 A1 Nov. 30, 2017

(30) Foreign Application Priority Data

May 30, 2016 (JP) ..... 2016-107550

(51) Int. Cl.

| | |
|---|---|
| ***H01R 13/62*** | (2006.01) |
| ***H01R 13/629*** | (2006.01) |
| ***H01R 13/428*** | (2006.01) |
| ***H01R 13/627*** | (2006.01) |

(52) U.S. Cl.

CPC ..... *H01R 13/62927* (2013.01); *H01R 13/428* (2013.01); *H01R 13/6271* (2013.01); *H01R 13/62955* (2013.01); *H01R 13/62977* (2013.01)

(58) Field of Classification Search

CPC ..... H01R 13/62933; H01R 13/62938; H01R 13/62955; H01R 13/62988

USPC ..... 439/157

See application file for complete search history.

(56) References Cited

U.S. PATENT DOCUMENTS

2009/0170358 A1* 7/2009 Shamoto ..... H01R 13/62938 439/157

2009/0181566 A1* 7/2009 Shibata ..... H01R 13/62938 439/157

FOREIGN PATENT DOCUMENTS

JP 2003-151682 5/2003

* cited by examiner

*Primary Examiner* — Phuong Dinh

(74) *Attorney, Agent, or Firm* — Gerald E. Hespos; Michael J. Porco; Matthew T. Hespos

(57) ABSTRACT

An operating member (11) is displaceable to an assembled position, an initial position and a connection position with respect to a housing (10) and proceeds with a connecting operation of the housing and a mating housing (12) by cam engagement with the mating housing (12) when being displaced from the initial position to the connection position. The housing (10) includes resilient locks (25, 26) configured to restrict a displacement of the operating member (11) in a direction opposite to that from the assembled position toward the initial position by resiliently locking the operating member (11) at the assembled position and restrict a displacement of the operating member (11) in a return direction from the initial position to the assembled position by resiliently locking the operating member (11) at the initial position.

1 Claim, 16 Drawing Sheets

CONNECTOR WITH LINEARLY MOVABLE OPERATING MEMBER THAT IS MOVABLE OPTIONALLY IN OPPOSITE FIRST AND SECOND MOVING DIRECTIONS FOR CONNECTING THE CONNECTOR TO A MATING CONNECTOR

BACKGROUND

1. Field of the Invention

The invention relates to a connector.

2. Description of the Related Art

Japanese Unexamined Patent Publication No. 2003-151682 discloses a connector with male and female housings that are connectable to each other, and a slider movably mounted on the female housing. The slider includes a coupling plate, and two sliding plates extend from the coupling plate to define a U-shape. Each sliding plate has a cam groove. The male housing includes a receptacle, and follower pins stand on outer surfaces of the receptacle. The female housing includes a tower, a skirt arranged on the outer periphery of the tower and covers arranged at upper and lower sides of the skirt. Insertion paths are provided between the covers and the skirt for receiving the sliding plates of the slider.

The sliding plates are inserted laterally into the insertion paths, and the slider is held at a retracted position prior to connecting the housings. The receptacle then is fit shallowly between the skirt and the tower of the female housing so that the follower pins enter the cam grooves. The slider then is pushed toward an advanced position. As a result the follower pins slide along edges of the cam grooves and generate a cam mechanism between the slider and the male housing to urge the housings toward a connected position. The housings are connected properly when the slider reaches the advanced position and the follower pins reach ends of the cam grooves in this way.

The coupling and adjacent parts of the slider project a large lateral distance from the housing when the slider is at the retracted position. Thus, the slider at the retracted position easily interferes with external matter a lateral side. As a result, the slider is kept at the advanced position and is transported to a site for connection to the male housing in a state where a lateral projecting amount of the slider is small. On the other hand, an operator can assemble the slider at an position different from the retracted and advanced positions and can displace the slider from the assembled position to the retracted position at the connecting operation site. However, if the assembled position is set separately from the retracted position and the housing is provided with locking means for keeping the slider at the retracted position and the assembled position, there is a problem of complicating a structure and making a mold structure cumbersome.

The invention was completed based on the above situation and aims to simplify a locking structure in a connector with an operating member displaceable to three positions with respect to a housing including an assembled position.

SUMMARY

The invention is directed to a connector with a housing that is connectable to a mating housing. The connector also has an operating member that is displaceable on the housing between an assembled position, an initial position and a connection position. The operating member is configured to generate a connecting operation of the housings by cam engagement with the mating housing when the slider is displaced from the initial position to the connection position. The housing includes a resilient lock configured to lock the operating member at the assembled position to restrict a displacement of the operating member from the assembled position toward the initial position. The resilient lock also locks the operating member at the initial position to restrict a displacement of the operating member in a return direction from the initial position to the assembled position.

According to the above configuration, the operating member can be assembled with the housing at the assembled position different from the initial position and the connection position. Thus, the resilient lock can lock and hold the operating member at both the initial position and the assembled position. Accordingly, a structure can be simplified as compared to the case where a locking structure is provided for each of the initial position and the assembled position.

The operating member may include a rotating mechanism configured to rotationally displace the operating member between the assembled position and the initial position and a sliding mechanism configured to linearly move and displace the operating member between the initial position and the connection position. However, in some embodiments, it may not matter which of the rotating mechanism and the sliding mechanism displaces the operating member between the assembled position and the initial position and between the initial position and the connection position.

The operating member may be linearly movable along the housing from the initial position to the connection position and a moving direction of the operating member from the initial position toward the connection position with respect to the housing may be selectable from a first movement path and a second movement path that are opposite to each other. The resilient lock may be composed of a first lock and a second lock paired at line-symmetrical positions with respect to a center of a length of the housing along the moving direction of the operating member. The first lock may lock the operating member at the initial position and the second lock may lock the operating member at the connection position when the operating member moves along the first movement path; and the second lock may lock the operating member at the initial position and the first lock may lock the operating member at the connection position when the operating member moves along the second movement path. According to this configuration, the movement path of the operating member from the initial position toward the connection position is selectable from the first and second movement paths. Thus, the movement path of the operating member can be determined depending on an installation situation and usefulness is enhanced. Further, the resilient lock may be composed of the first and second locks, and locking means for keeping the operating member at the initial position and the connection position are realized by the first and second locks and are not doubled as compared to the case where the operating member moves only in one direction. Thus, the structure can be simplified.

DETAILED DESCRIPTION

An embodiment of the invention is described with reference to FIGS. 1 to 16. A connector of this embodiment includes a housing 10 and an operating member 11. The housing 10 is connectable to a mating housing 12. Note that, in the following description, end of the housings 10, 12 that face each other at the start of connection are referred to as front end concerning a front-rear direction. A vertical direction is based on FIG. 13 and equivalent to a direction perpendicular to the plane of FIG. 1. Further, a lateral direction is based on FIG. 1.

Figure 2:
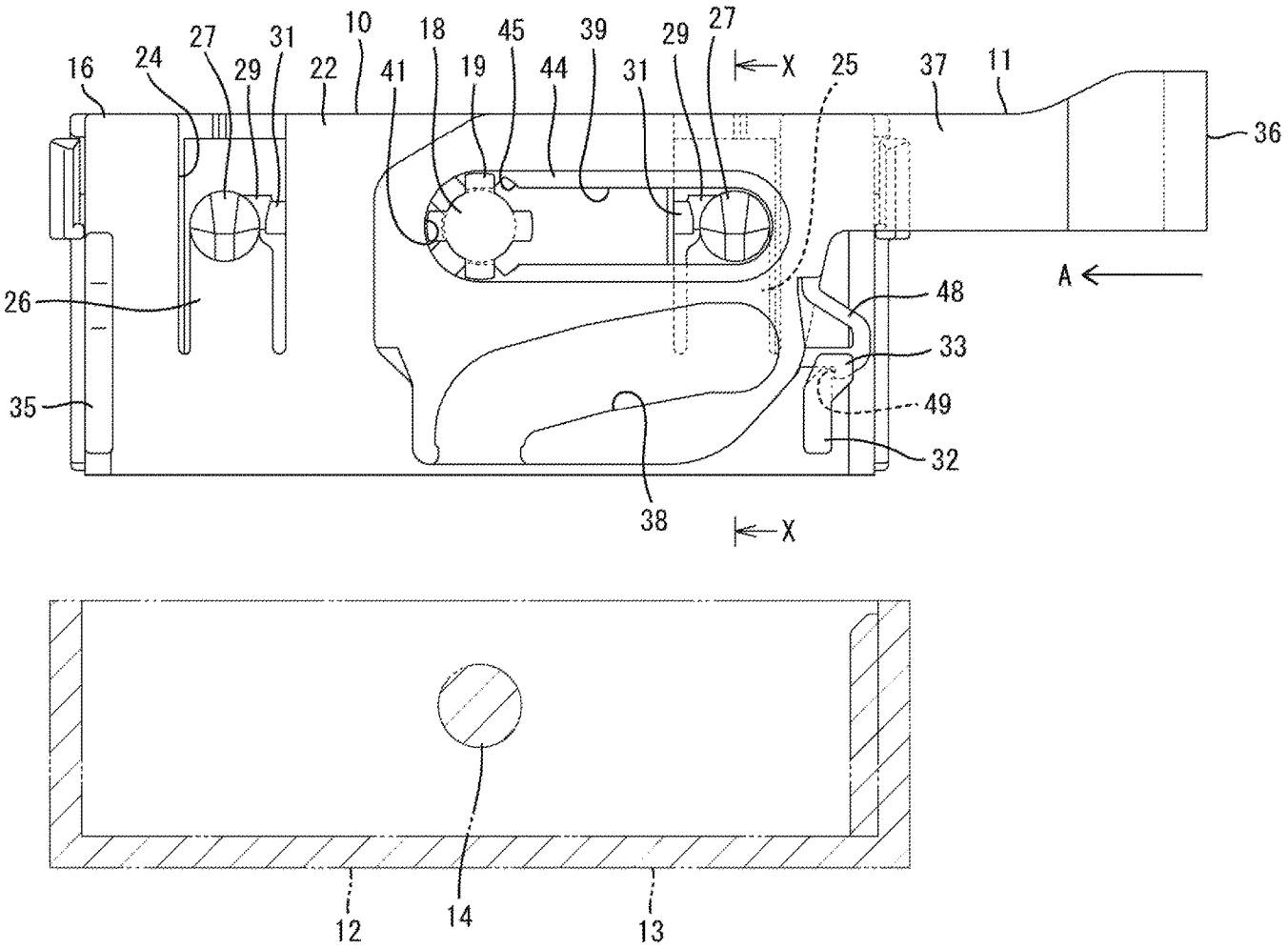
FIG. 2 is a plan view showing a state where the operating member is at an initial position with respect to the housing and facing a mating housing.

The mating housing 12 is made of synthetic resin and includes a rectangular tubular receptacle 13 that is long and narrow in the lateral direction, as shown in FIG. 2. Cylindrical cam followers 14 project on laterally central parts of inner surfaces of upper and lower walls extending along a long side direction. Unlocking ribs 15 are provided on one lateral end part of the inner surface of each of the upper and lower walls and extend in the front-rear direction. Tabs of unillustrated male terminal fittings project in the receptacle 13.

Figure 11:
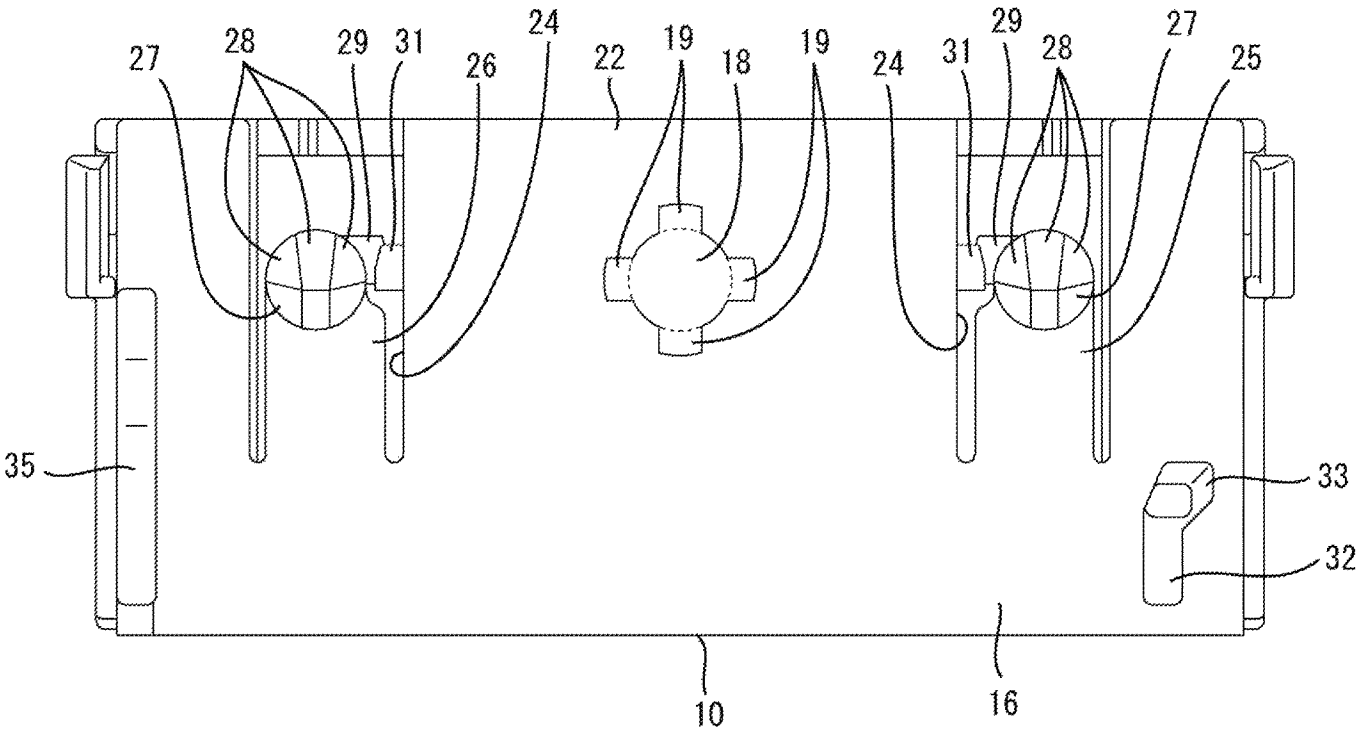
FIG. 11 is a plan view of the housing.
Figure 12:
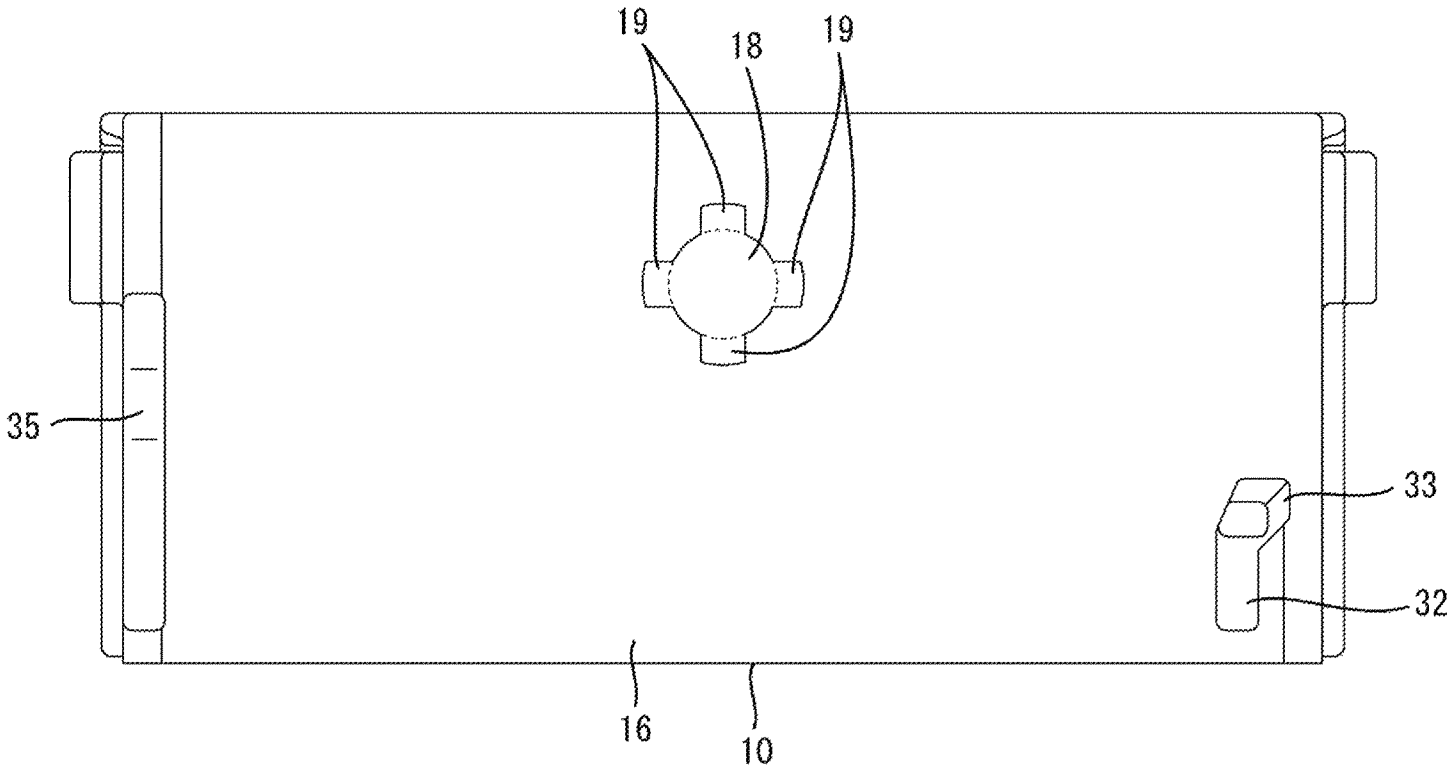
FIG. 12 is a bottom view of the housing.
Figure 13:
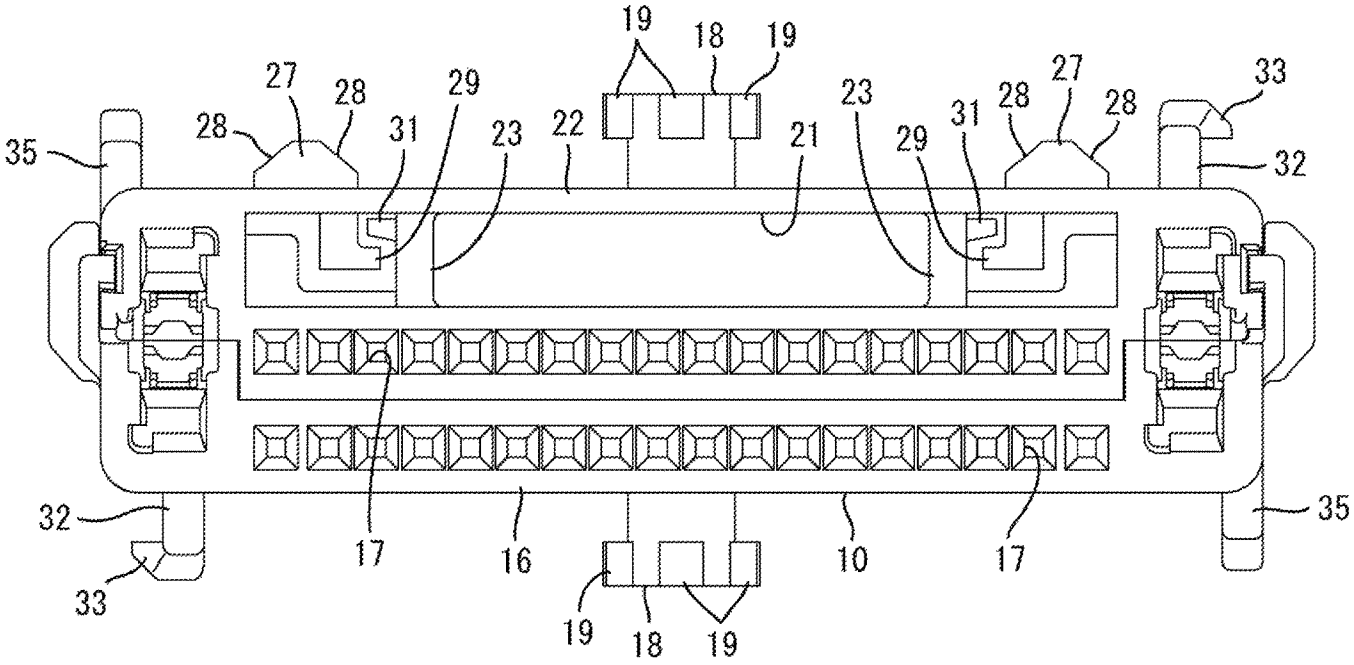
FIG. 13 is a front view of the housing.

The housing 10 is made of synthetic resin and includes a housing body 16, as shown in FIGS. 11 to 13. The housing body 16 is a wide rectangular block that is configured to fit into the receptacle 13. As shown in FIG. 13, cavities 17 penetrate through the housing body 16 in the front-rear direction. The cavities 17 are arranged side by side in a width direction in upper and lower stages, and unillustrated female terminal fittings are inserted and held therein. Each female terminal fitting is crimped and connected to an end part of an unillustrated wire and is connected conductively to the mating male terminal fitting when the housings 10, 12 are connected properly.

Cylindrical support shafts 18 project in laterally central parts of both upper and lower surfaces of the housing body 16. Four circumferentially spaced jaws 19 protrude radially from a tip of a cylindrical part of each support shaft 18. Each jaw 19 is rectangular in a plan view, and the jaws 19 are arranged at intervals of 90° to the front, rear, left and right of the tip of the cylindrical part.

As shown in FIG. 13, a wide flat space 21 penetrates through the housing body 16 in the front-rear direction at a position above the respective cavities 17, and a flat and plate-like thin wall 22 extending in the lateral direction is provided to close an upper side of the space 21. Further, the interior of the space 21 is divided by separation walls 23 disposed on both left and right sides.

As shown in FIG. 11, cutout grooves 24 are provided on left and right end parts of the thin wall 22. The grooves 24 extend in the front-rear direction and are open on a rear end while communicating with the space 21. An inner edge of the groove 24 is continuous with a surface of the separation wall 23. Plate shaped resilient locks 25 and 26 are cantilevered rearward from both left and right parts of the thin wall 22 between a pair of the grooves 24. The resilient locks 25, 26 are deflectable and deformable vertically with the front ends serving as supports.

As described later, the resilient locks 25, 26 have a function of locking and holding the operating member 11 on the housing 10 in a movement restricted state, and define a first lock 25 (right side of FIG. 11) and a second lock 26 (left side of FIG. 11). The first and second locks 25, 26 are line-symmetrically shaped and are arranged at line-symmetrical positions across a laterally central part of the housing body 16 on opposite sides of the support shafts 18. Note that, in the following description, unless it is particularly necessary to distinguish the first and second locks 25, 26, the first and second locks 25, 26 are referred to collectively as the resilient locks 25, 26.

As shown in FIG. 11, rear ends of the plates of the resilient locks 25, 26 are forward from the rear end of the housing 10. Lock projections 27 project up on rear ends of the plates of the resilient locks 25, 26. Each lock projection 27 is circular in a plan view and has tapered slopes 28 inclined up toward a tip in a projecting direction on rear and both left and right surfaces. The lock projections 27 are arranged laterally side by side at the same position as the support shafts 18 in the front-rear direction.

As shown in FIG. 13, excessive deflection restricting pieces 29 are provided on the tip parts of the plates of the resilient locks 25, 26 and projecting down in the space 21. Each excessive deflection restricting piece 29 has a vertical part hanging down from the plate and a horizontal part bent at a right angle from the lower end of the vertical part toward the separation wall 23 to define an L-shaped in a front view.

An excessive deflection restriction receiving piece 31 projects above the horizontal part of the excessive deflection restricting piece 29 on the surface of the separation wall 23. The excessive deflection restriction receiving piece 31 is at a predetermined distance from and parallel to the excessive deflection restricting piece 29. The resilient lock 25, 26 is deflected and deformed up and the excessive deflection restricting piece 29 contacts the excessive deflection restriction receiving piece 31 from below to prevent further deflection of the resilient lock 25, 26. Thus, even if the resilient lock 25, 26 is caught by external matter, such as a looped wire, the resilient lock 25, 26 cannot be turned out and broken. Note that, as shown in FIG. 11, a side edge part of a tip part of the resilient lock 25, 26 on the side of the separation wall 23 (on the side of the support shaft 18) is cut due to the molding of the excessive deflection restriction receiving piece 31.

As shown in FIG. 13, a lock receiving portion 32 is provided on one lateral end of each of the upper and lower surfaces of the housing body 16. Two of the lock receiving portions 32 are point-symmetrically shaped and are at point-symmetrical positions with respect to a center of the housing body 16 (axial center when the housing body 16 is viewed from the front). As shown in FIG. 11, each lock receiving portion 32 includes a rib-like part extending in the front-rear direction and is arranged in front of and laterally to the resilient locks 25, 26 (right side of FIG. 11). A space into which the unlocking portion 15 of the mating housing 12 is inserted when the both housings 10, 12 are connected is secured laterally to the lock receiving portion 32.

Figure 4:
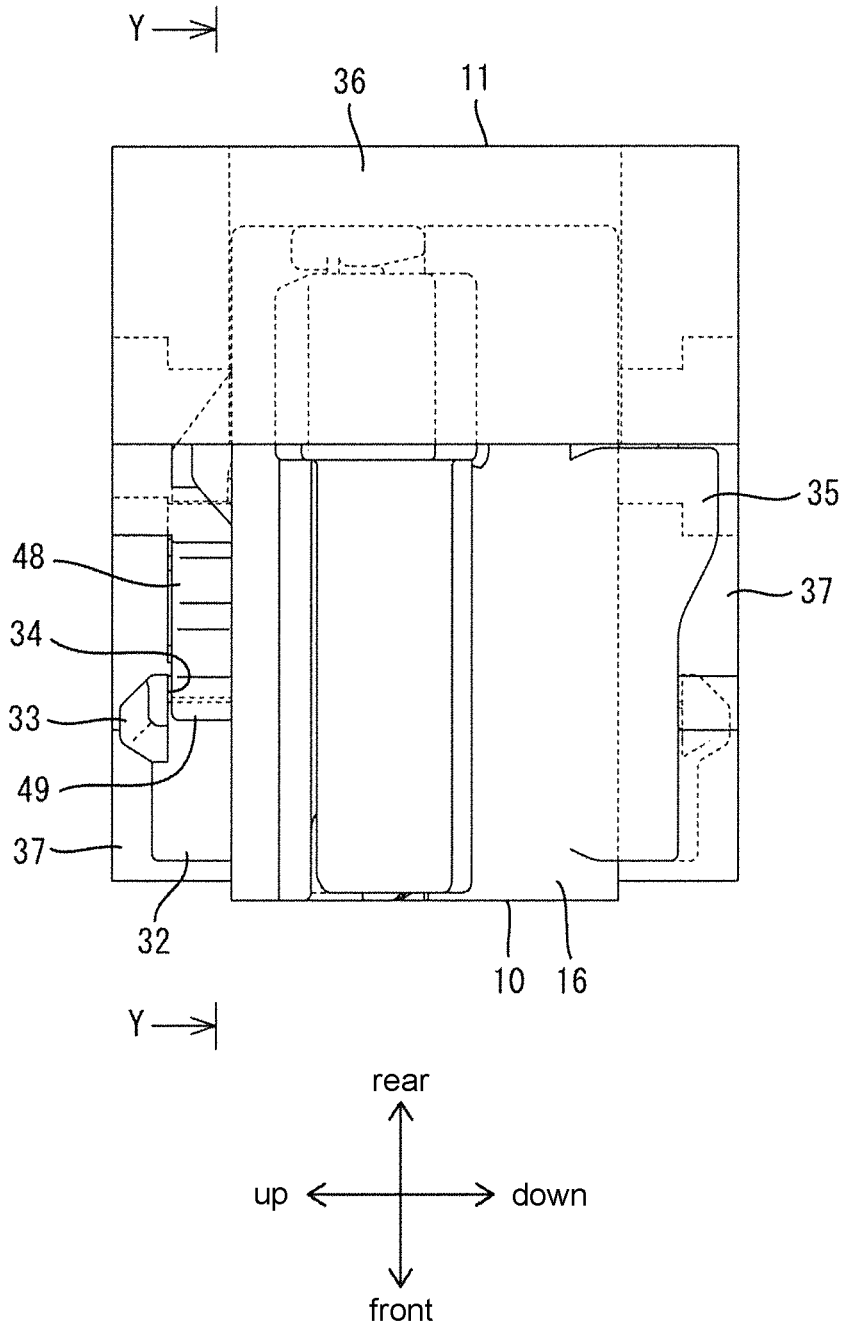
FIG. 4 is a side view showing the state where the operating member is at the initial position with respect to the housing.

As shown in FIGS. 11 to 13, the lock receiving portion 32 has a receiving piece 33 bent and protruding rearward and laterally on a rear end side of a tip part of the rib-like part in a projecting direction. As shown in FIG. 4, an insertion recess 34 is defined between the receiving piece 33 and the rib-like part and receives a later-described locking projection 49 of the operating member 11.

As shown in FIG. 13, a stopper 35 is provided on the other lateral end of each of the upper and lower surfaces of the housing body 16 and is in the form of a plate extending in the front-rear direction. The two stoppers 35 are shaped point-symmetrically at point-symmetrical positions with respect to the center of the housing body 16. As shown in FIG. 11, the stoppers 35 are longer in the front-rear direction than the lock receiving portions 32 and arranged along side surfaces of the housing body 16. As shown in FIG. 4, the rear end of each stopper 35 protrudes in the vertical direction and is arranged perpendicularly. As described later, the operating member 11 can be stopped at an initial position in contact with the stopper 35.

Figure 1:
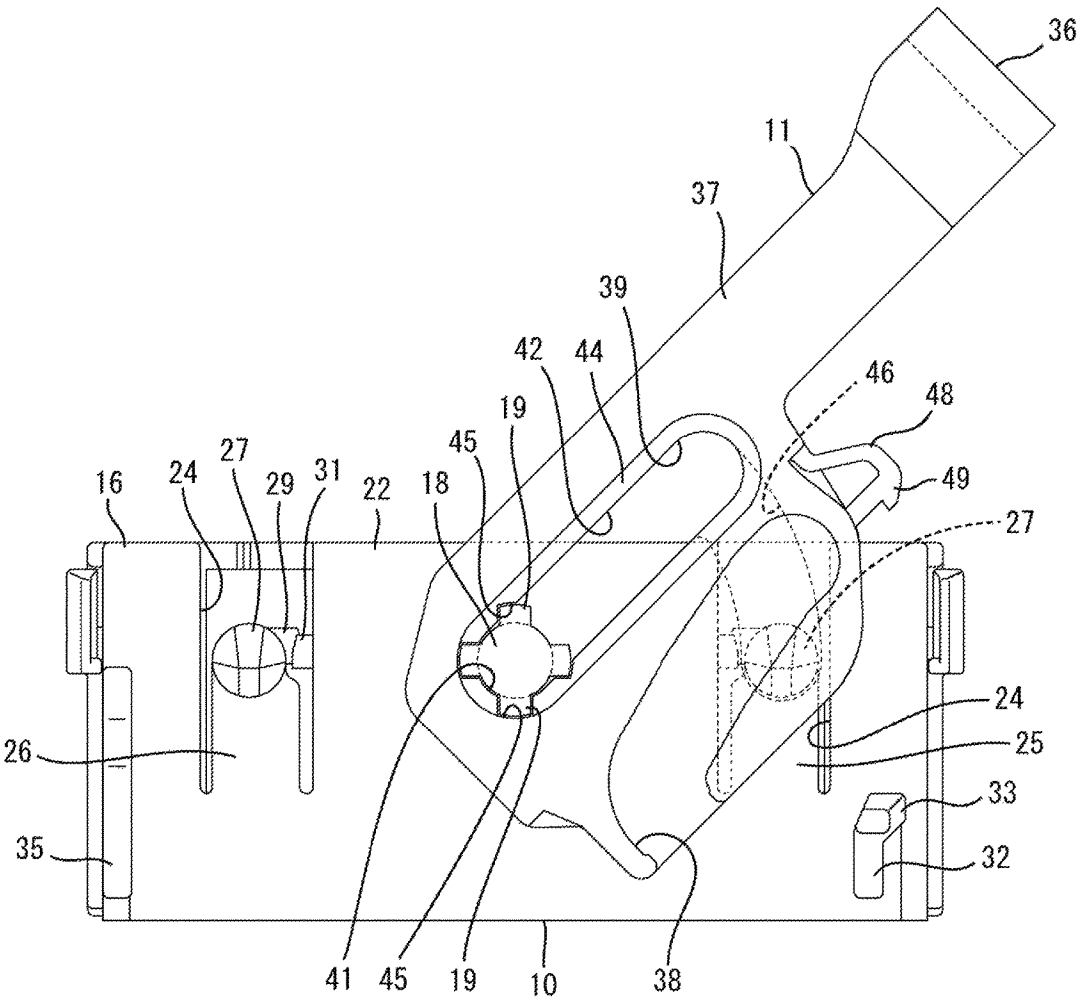
FIG. 1 is a plan view of a connector of one embodiment showing a state where an operating member is at an assembled position with respect to a housing.
Figure 8:
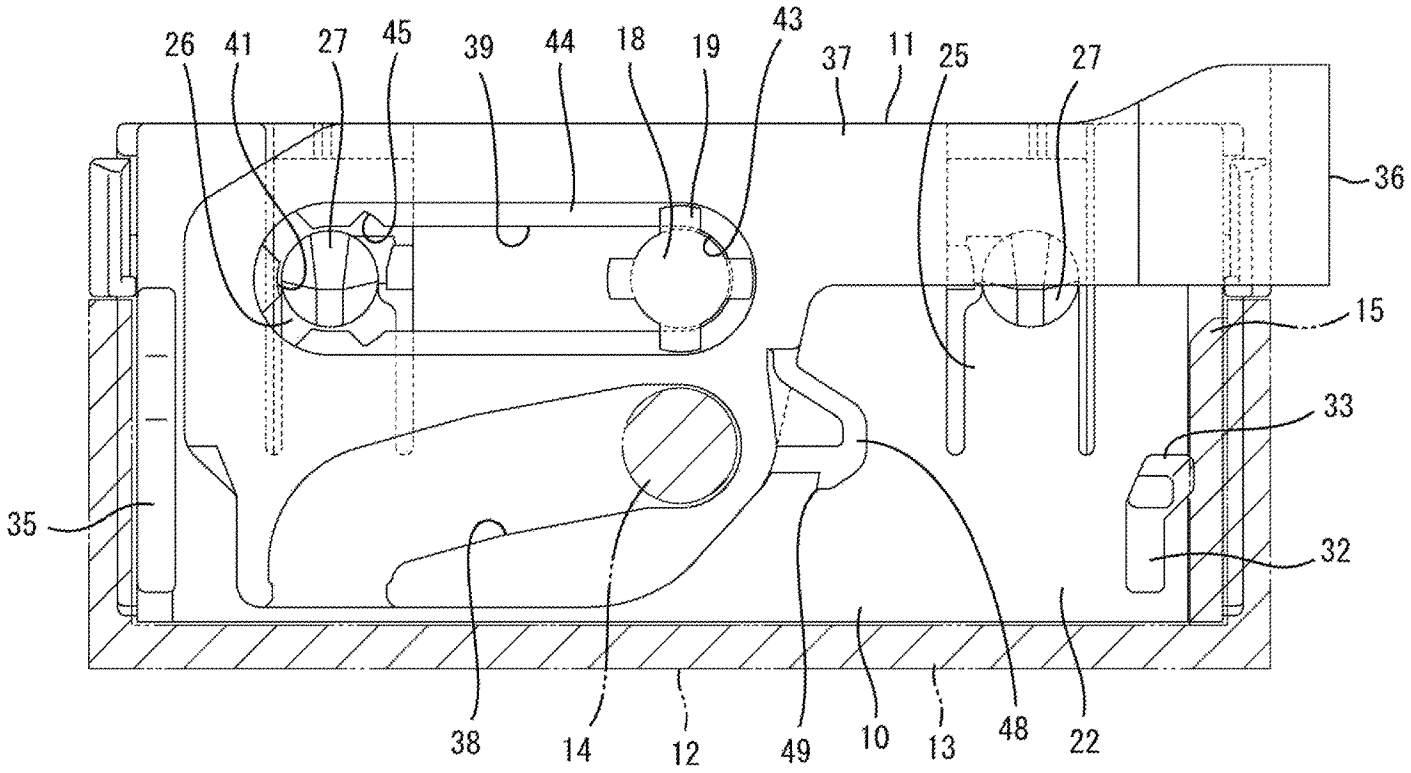
FIG. 8 is a plan view showing the state where the operating member is at the connection position with respect to the housing.
Figure 15:
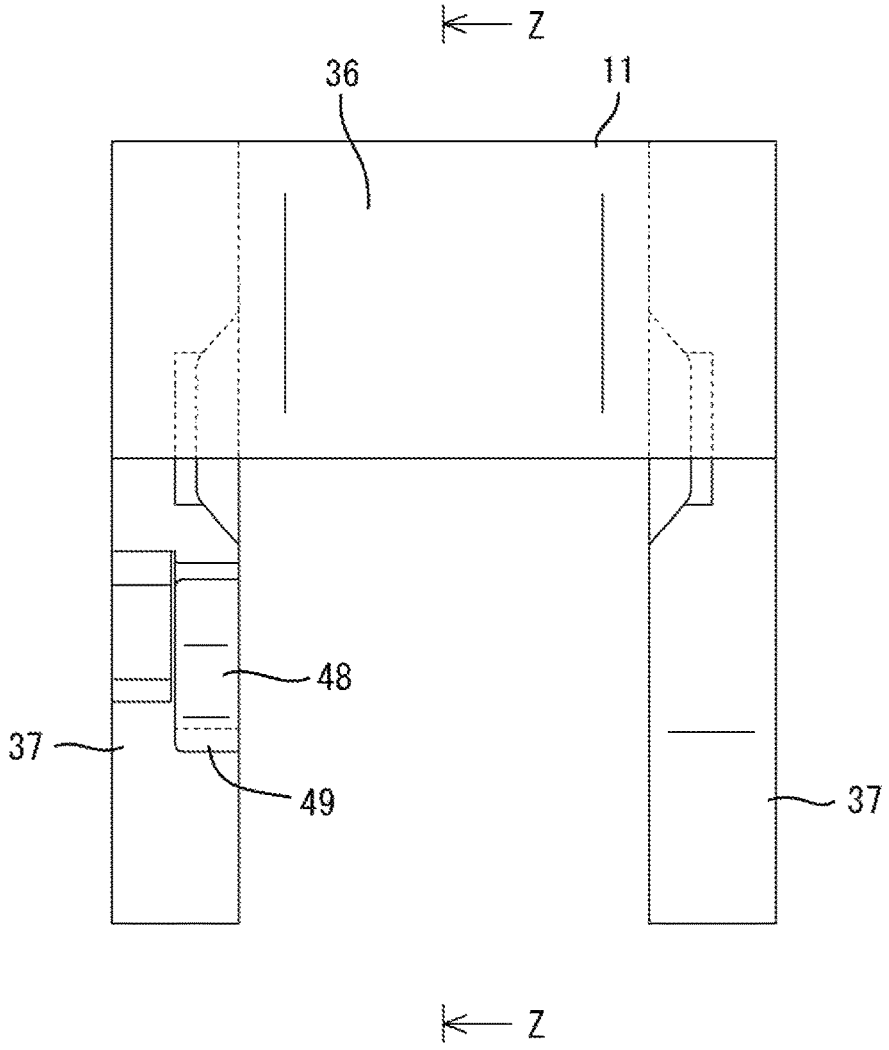
FIG. 15 is a side view of the operating member.

The operating member 11 is made of synthetic resin, and includes a coupling 36 and two arms 37 projecting parallel to each other from ends of the coupling 36 to define a U-shape, as shown in FIG. 15. This operating member 11 is displaceable, with respect to the housing 10, from an assembled position (see FIG. 1), the initial position (see FIG. 2) and a connection position (see FIG. 8). The arms 37 project obliquely rearward at an angle of inclination of about 45° with respect to the front-rear direction and the lateral direction when the operating member is in the assembled position (FIG. 1). The arms 37 project large amounts laterally of the housing 10 along the lateral direction when the operating member is in the initial position (FIG. 2). The arms 37 project slightly laterally of the housing 10 along the lateral direction or are arranged without projecting when the operating member 11 is in the connection position (FIG. 8)

The operating member 11 includes a rotating mechanism and a sliding mechanism. The rotating mechanism is configured to displace the operating member 11 rotationally from the assembled position to the initial position with respect to the housing 10 to gradually increase a laterally projecting amount toward the initial position. The sliding mechanism is configured to displace the operating member 11 linearly in the lateral direction along the housing 10 from the initial position to the connection position to gradually decrease the laterally projecting amount toward the connection position. Further, a movement path of the operating member 11 can be selected from a first movement path (see arrow A of FIG. 2) and a second movement path (see arrow B of FIG. 9). With the first movement path (arrow A of FIG. 2), the operating member 11 moves from the side of the first lock 25 toward the side of the second lock 26. With the second movement path (arrow B of FIG. 9), the operating member 11 is inverted vertically from a moving posture along the first movement path and moves from the side of the second lock 26 toward the side of the first lock 25 when the operating member 11 is moved toward the connection position by the sliding mechanism.

The coupling 36 is a plate extending in the vertical direction and an operator can grip the coupling 36 by the fingers.

Figure 14:
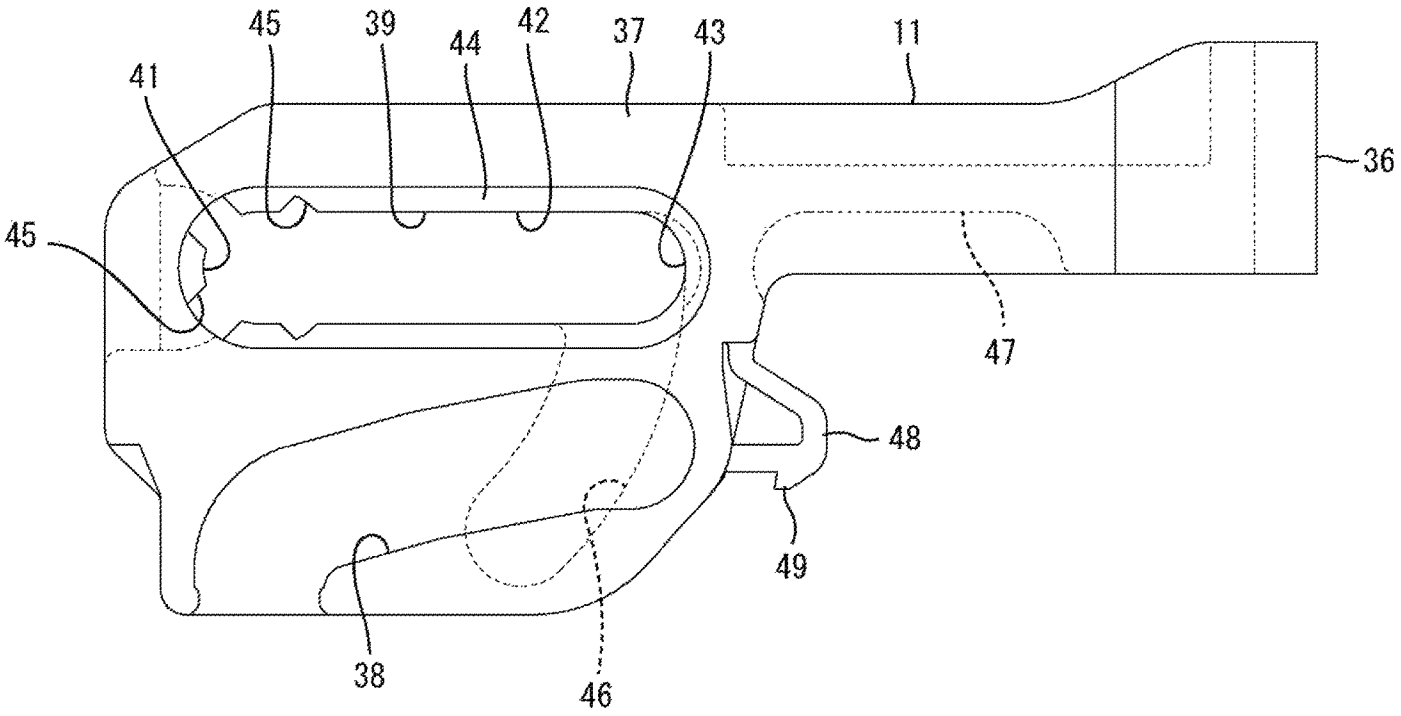
FIG. 14 is a plan view of the operating member.

As shown in FIG. 14, a side of each of the arms 37 distant from the coupling 36 forms a flat plate-shaped body expanded in the front-rear direction, and a cam groove 38 is provided in the body. The cam groove 38 is a bottomed groove formed by recessing an outer surface of the body of the arm 37, extends in a curved manner and is open on the front end edge of the body. The cam groove 38 engages the cam follower 14 of the mating housing 12 to proceed with the connecting operation of the housings 10, 12 when the operating member 11 moves from the initial position to the connection position.

A linearly extending long groove 39 is provided in an area of the body of each of the arms 37 behind the cam groove 38. The long groove 39 penetrates through the arm 37 in a plate thickness direction and is arranged along the lateral direction when the operating member 11 is at the initial position and the connection position. The support shaft 18 is inserted into the long groove 39 and slides in contact with an engaging edge 44 of the long groove 39 to guide a moving operation of the operating member 11 when the operating member 11 moves between the initial position and the connection position.

The long groove 39 receives the support shaft 18 at an end 41 distant from the coupling 36 (see FIG. 1) and can slide in contact with the support shaft 18 in an extending portion 42 that linearly extends from the end 41 toward the coupling 36. The engaging edge 44 extends along the edge of the long groove 39 in the plate thickness direction of the arm 37 to face the housing body 16 and protrudes over the entire periphery except at escaping recesses 45 to be described later. As shown in FIG. 8, the engaging edge 44 protrudes slightly less than the jaws 19 of the support shaft 18. The engaging edge 44 slides in contact with the jaws 19 of the support shaft 18 inserted into the long groove 39 from inside except at the initial position and restricts outward expanding deformation (opening deformation) of the arm 37.

As shown in FIGS. 1 and 14, the end 41 of the long groove 39 is provided with the escaping recesses 45 by partially cutting off the engaging edge 44. The escaping recesses 45 have a rectangular or triangular cross-sectional shape so that the jaws 19 are fittable inside. When the operating member 11 is arranged at the assembled position and the arms 37 are inclined at 45°, the escaping recesses 45 are open at intervals of 90° on front, rear, left and right sides of the engaging edge 44.

Figure 16:
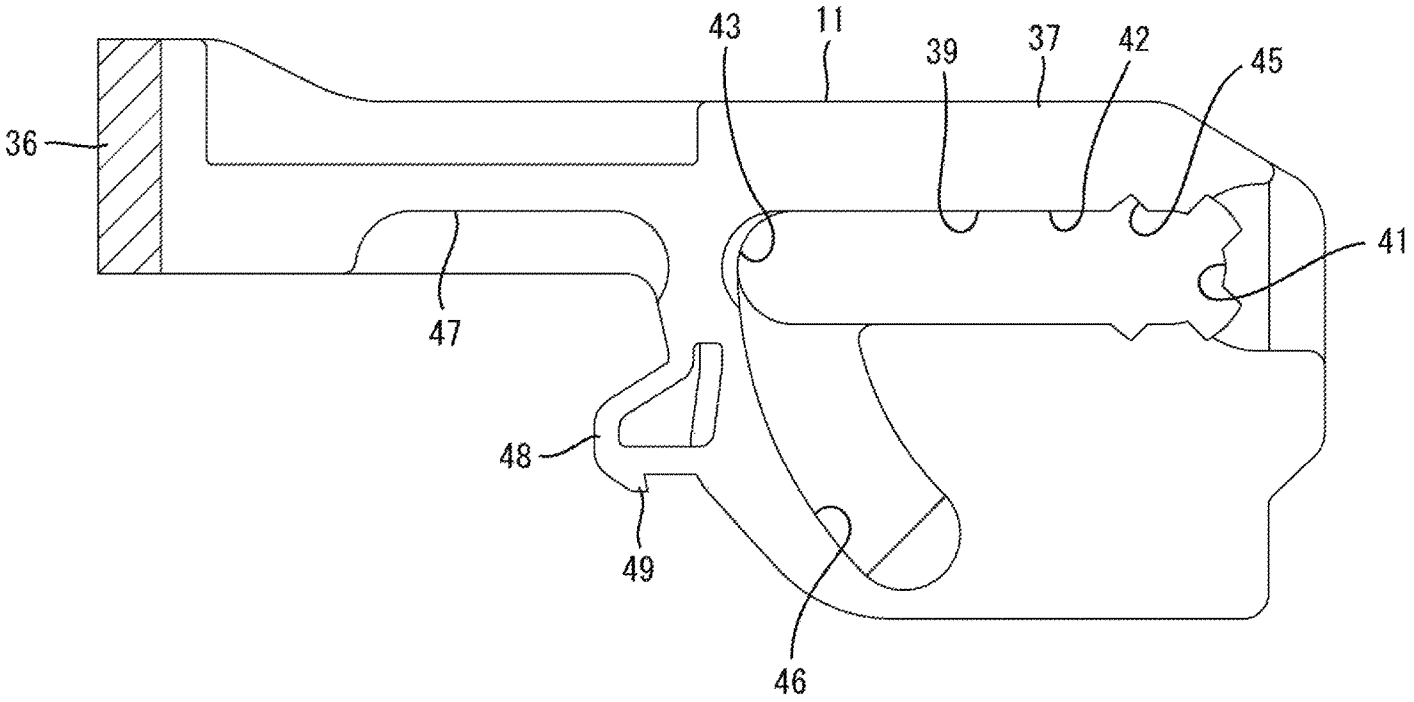
FIG. 16 is a section along Z-Z of FIG. 15.

As shown in FIG. 16, a bottomed guide groove 46 is provided on the inner surface of the body part of each of the arms 37 and extends forward from an end 43 of the long groove 43 on the side of the coupling 36. The guide groove 46 is shallower than the cam groove 38. When the operating member 11 is displaced rotationally between the assembled position and the initial position, the lock projection 27 of the resilient lock 25, 26 is inserted into the guide groove 46 to be slidable in contact with the guide groove 46. The guide groove 46 is curved along an arc centered on a center of rotation of the operating member 11.

A bottomed escaping groove 47 is provided in an inner surface of a plate that connects the body part and the coupling 36 in each of the arms 37. The escaping groove 47 is arranged at the same position as the long groove 39 in the front-rear direction, extends in the lateral direction and is open on the front end edge of the plate of the arm 37. The lock projection 27 of the resilient lock 25, 26 is inserted into the escaping groove 47 to be allowed to escape when the operating member 11 moves between the initial position and the connection position.

A resilient piece 48 is provided on one 37 of the arms 37 and projects laterally toward the coupling 36 along a plate surface of the arm 37 from an outer edge of the body part. The resilient piece 48 is curved to form a U-shaped beam with both ends coupled to the body of the arm 37, and is thinner than the body of the arm 37. A claw-like locking projection 49 projects forward on a tip part of the U-shaped central part) of the resilient piece 48 in a projecting direction.

Next, functions of the connector are described.

The operating member 11 is separated from the housing 10 for transportation to a connector assembly site. The terminal fittings are inserted into the cavities 17 of the housing 10 at the connector assembly site and then the operating member 11 is assembled with the housing 10 at the assembled position (see FIG. 1). During assembly, the operating member 11 is pushed to straddle the housing 10 obliquely from the rear. Then, after both arms 37 are expanded, the escaping recesses 45 of the long grooves 39 pass through the jaws 19 of the support shafts 18 and the support shafts 18 are fit into the ends 41 of the long grooves 39.

The lock projection 27 of the first lock 25 is inserted into the guide groove 46 of the arm 37 when the operating member 11 reaches the assembled position. At this time, the lock projection 27 contacts a front end part of the guide groove 46 to restrict a rotational displacement of the operating member 11 in a direction away from the initial position (see FIG. 1). Note that the operator can continuously perform a series of operations while gripping the coupling 36 of the operating member 11.

Subsequently, the operating member 11 is rotated about the support shafts 18 that have been inserted into the ends 41 of the long grooves 39 to move in a clockwise direction of FIG. 1 from the assembled position toward the initial position. The rear slope 28 of the lock projection 27 slides in contact with the back surface of the guide groove 36 and the first lock 25 is deformed while the operating member 11 is rotated. Large resistance is not applied to the operating member 11 from the side of the housing 10. Further, as the operating member 11 is rotated from the assembled position toward the initial position, the engaging edges 44 of the long grooves 39 slide in contact with the jaws 19 of the support shafts 18 from inside, thereby restricting detachment of the arms 37 from the support shafts 18.

Figure 3:
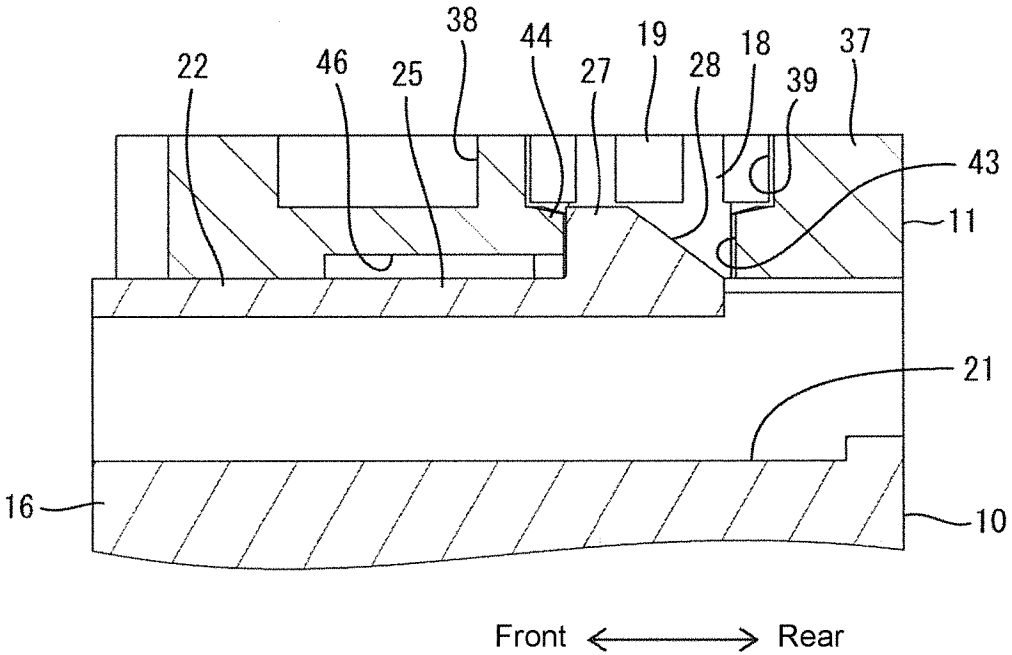
FIG. 3 is a section along X-X of FIG. 2.

When the operating member 11 reaches the initial position, the first lock 25 is displaced resiliently in a return direction and the lock 27 is transferred and inserted into the other end 43 of the long groove 39 from the guide groove 46 (see FIG. 3). The engaging edge 44 of the long groove 39 contacts the lock projection 27 from the front to restrict rotation of the operating member 11 in the return direction toward the assembled position. Further, the plate of the arm 37 on the side where the resilient piece 48 is not provided is stopped in contact with the rear end of the stopper 35, thereby restricting further rotation of the operating member 11 beyond the initial position (see FIG. 4).

Figure 5:
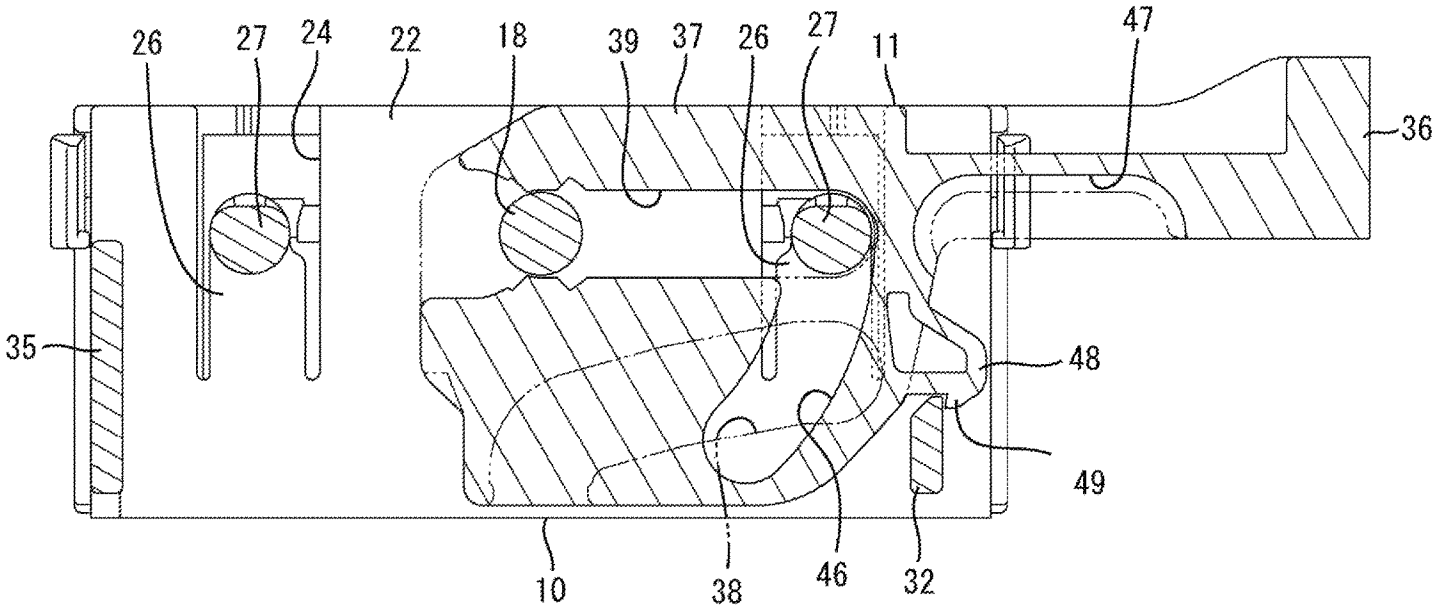
FIG. 5 is a section along Y-Y of FIG. 4.

When the operating member 11 reaches the initial position, the locking projection 49 of the resilient piece 48 is arranged for laterally contacting the rear end of the rib-like part of the lock receiving portion 32, thereby restricting movement of the operating member 11 from the initial position toward the connection position (see FIG. 5). At this time, the locking projection 49 of the resilient piece 48 is fit into the insertion recess 34 at an inner side of the receiving piece 33 (see FIG. 4). In this way, the receiving piece 33 protects the locking projection 49 and ensures that external mater does not interfere with the locking projection 49 to inadvertently unlock the locking projection 49 from the lock receiving portion 32. Further, the support shafts 18 are kept inserted in the ends 41 of the long grooves 39 and can contact the ends 41 at the initial position. Thus, a movement of the operating member 11 in a direction opposite to that toward the connection position is also restricted (see FIG. 2).

Figure 6:
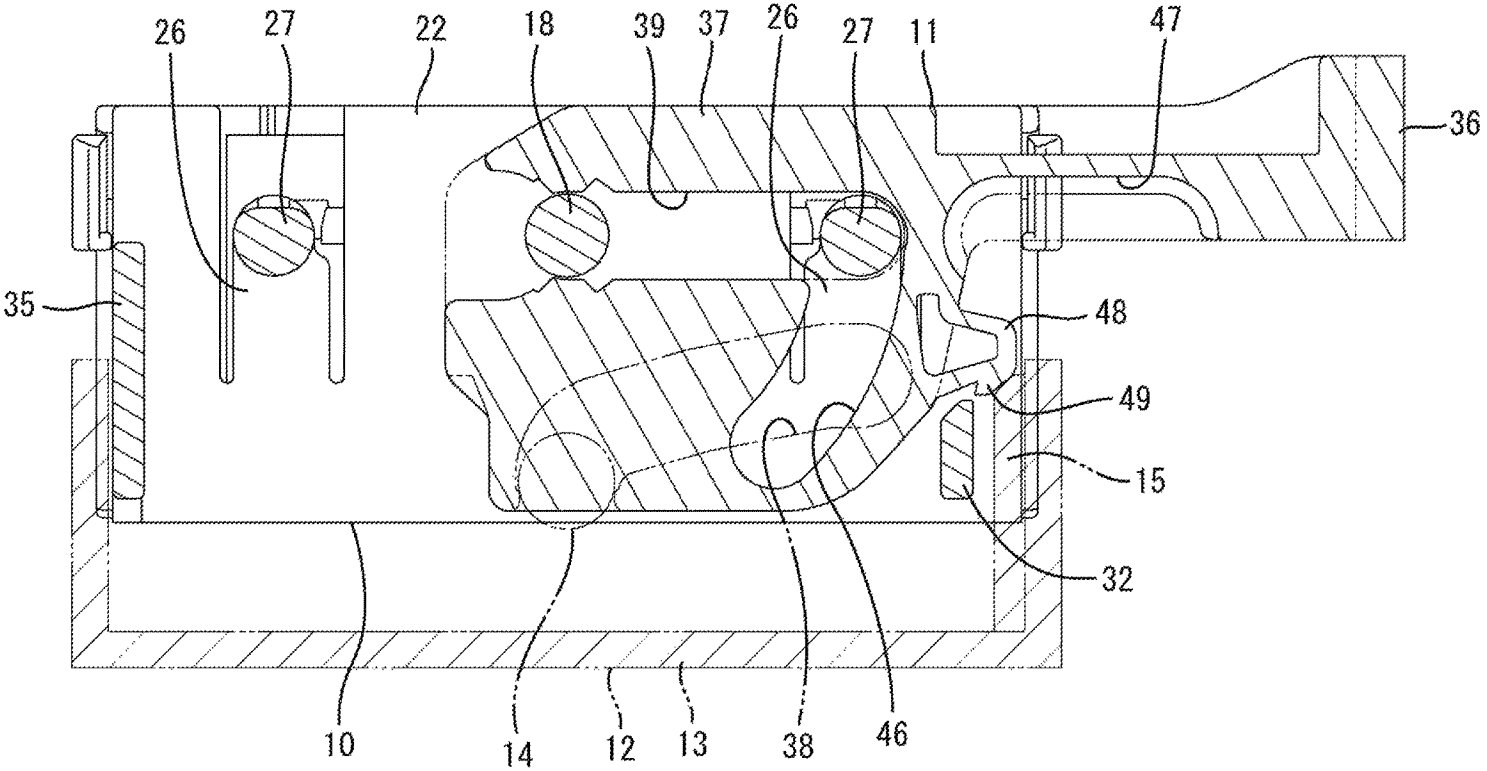
FIG. 6 is a view, corresponding to FIG. 5, showing a state where the mating housing is connected shallowly and a resilient piece and a lock receiving portion are unlocked by an unlocking portion of the mating housing.
Figure 7:
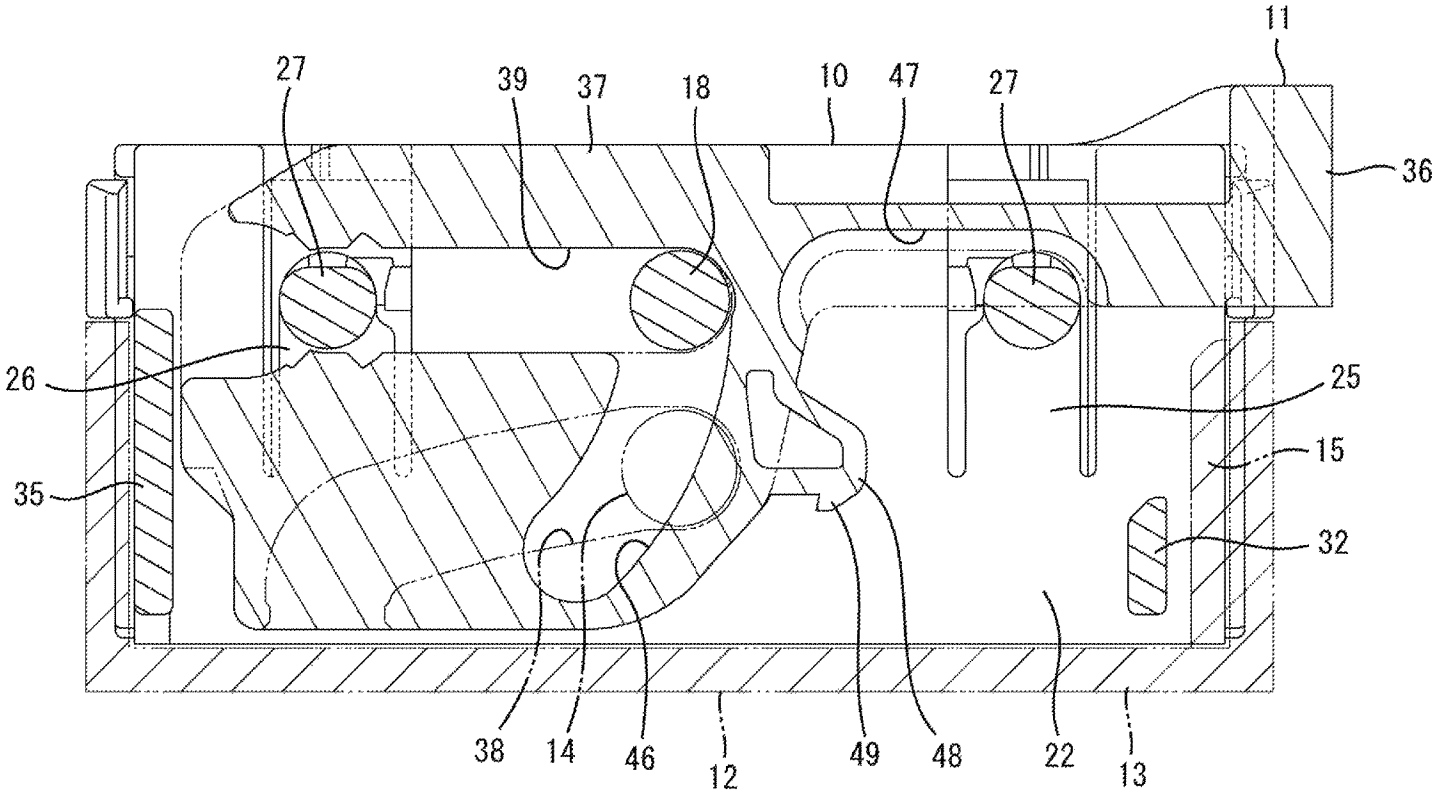
FIG. 7 is a view, corresponding to FIG. 5, showing a state where the operating member is at a connection position with respect to the housing.

In the above state, the receptacle 13 of the mating housing 12 is fit shallowly to the housing 10 and the cam followers 14 enter the cam grooves 38 (see FIG. 6). Further, the unlocking portion 15 presses the tip of the resilient piece 48 in the projecting direction so that the resilient piece 48 is deformed to incline rearward while extending along a plate surface direction of the arm 37. In this way, the locking projection 49 is separated from the rib-like part of the receiving piece 32 to unlock the resilient piece 48 and the receiving piece 32 from each other and enable the operating member 11 to be moved to the connection position. Further, deforming the resilient piece 48 along the inner surface of the receiving piece 33 ensures that interference of the resilient piece 48 and the receiving piece 33 is avoided.

The operating member 11 then is moved linearly toward the connection position (side where the second lock 26 is located) along the first movement path. In an initial stage of moving the operating member 11 toward the connection position, the arm 37 slides on the lateral slope 28 of the lock projection 27 and the first lock 25 is deflected and deformed inwardly. When the operating member 11 is moved further toward the connection position, the lock projection 27 enters the escaping groove 47 and escapes so that the first lock 25 is returned resiliently to a natural state.

In the process of moving the operating member 11 along the first movement path, the support shafts 18 are displaced relative to the long grooves 39 in a direction away from the ends 41 and the jaws 19 at the front and rear sides of the support shafts 18 slide in contact with the engaging edges 44 of the long grooves 39 from outside. In this way, a movement of the operating member 11 is guided. Further, in the process of moving the operating member 11, the cam followers 14 of the mating housing 12 slide in contact with the edges of the cam grooves 38, a cam mechanism acts between the operating member 11 and the mating housing 12, and the connecting operation of the housings 10, 12 proceeds with a low connecting force. During this time, the arms 37 of the operating member 11 may deform out and away from the outer surfaces of the housing body 16 due to connection resistance. However, the engaging edges 44 of the long grooves 39 contact the front and rear jaws 19 from inside to restrict expanding movements of the arms 37. As a result, the arms 37 cannot deform and detach from the housing 10.

In a stage immediately before the operating member 11 reaches the connection position, the tip of the arm 37 in a moving direction slides on the lateral slope 28 of the lock projection 27 of the second lock 26 and the second lock 26 is deflected inward. When the operating member 11 reaches the connection position, the second lock 26 is displaced resiliently in a return direction and the lock projection 27 is inserted into the end 41 of the long groove 39 from inside (see FIG. 8). At this time, the lock projection 27 contacts the end 41 of the long groove 39 in the lateral direction (moving direction along the first movement path) to restrict movement of the operating member 11 in the return direction toward the initial position. Further, when the operating member 11 reaches the connection position, the support shafts 18 contact the other ends 43 of the long grooves 39 and the coupling 36 is arranged to contact the side surface of the housing 10, thereby restricting further movement of the operating member 11 beyond the connection position. Furthermore, the lock projection 27 of the second lock 26 is arranged in the end 41 of the long groove 39 and the support shaft 18 is arranged in the other end 43 of the long groove 39 to restrict a rotational displacement of the operating member 11. At the connection position, the cam followers 14 are located in final end parts of the cam grooves 38 and the housings 10, 12 are connected properly.

On the other hand, a situation may arise in which the operating member 11 cannot be moved along the first movement path due to an interfering object to the right side of FIG. 2. Thus, the operating member 11 at the initial position interferes with the interfering object. In this situation, it is selected to move the operating member 11 along the second movement path opposite to the first movement path.

Figure 9:
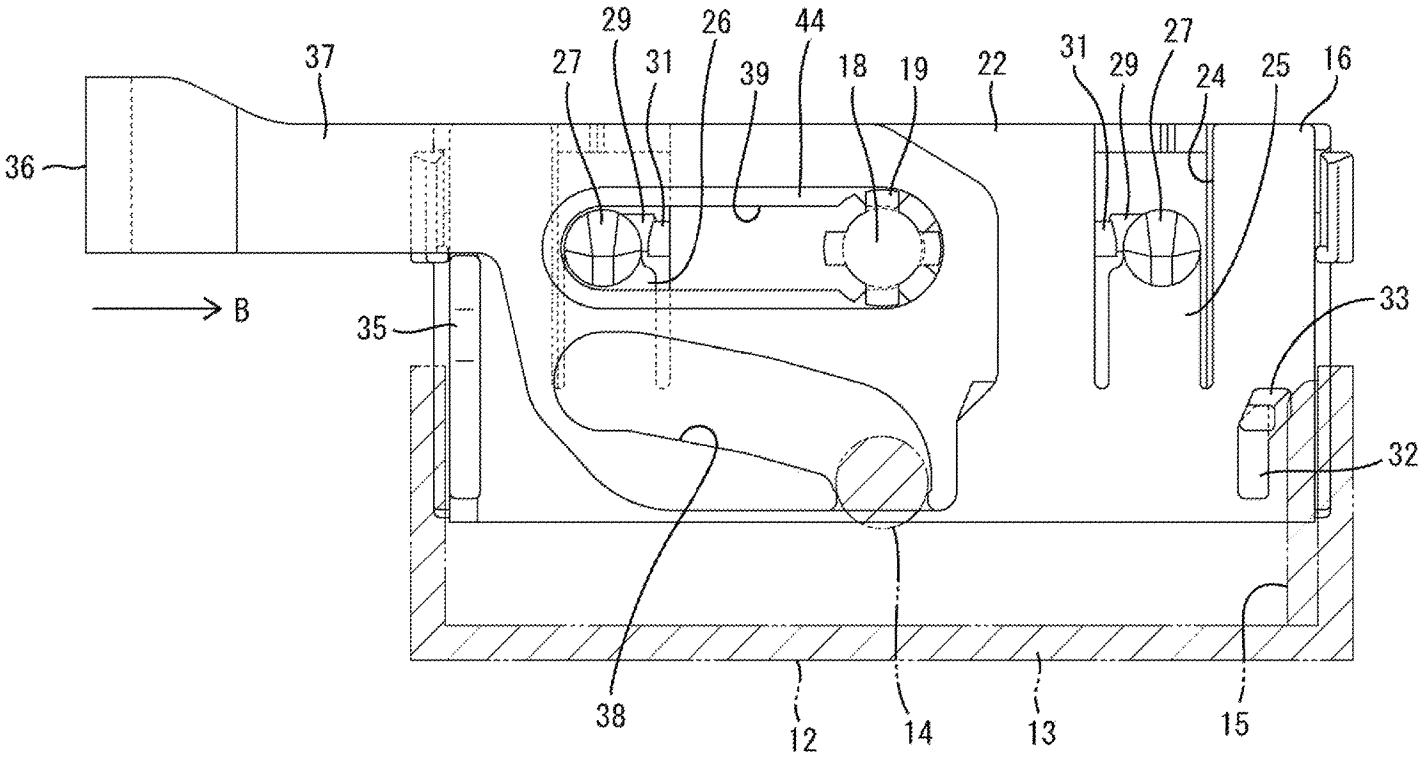
FIG. 9 is a plan view showing a state where the operating member is at the initial position in an orientation opposite to that in FIG. 2 with respect to the housing.
Figure 10:
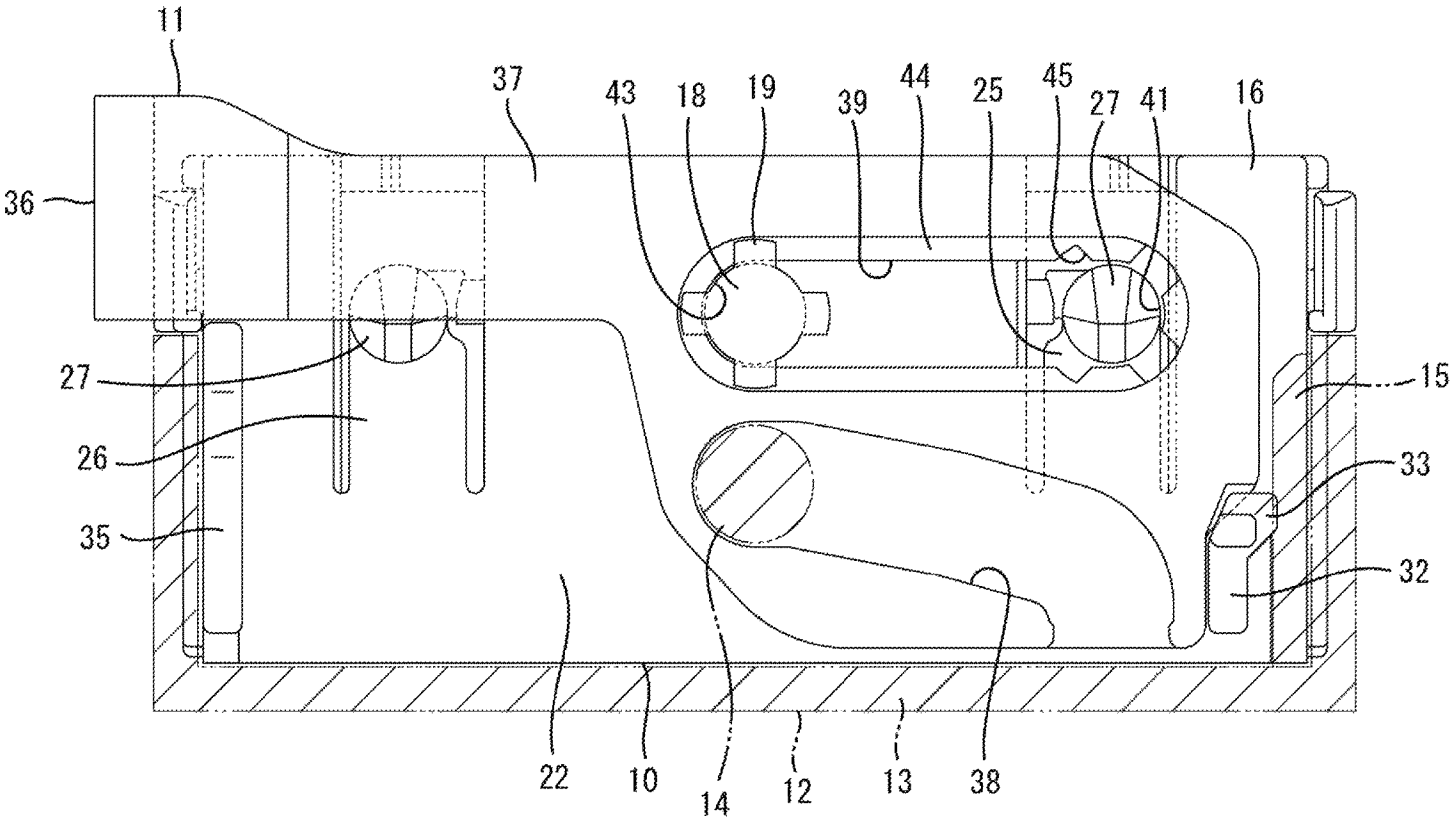
FIG. 10 is a plan view showing a state where the operating member is at the connection position in an orientation opposite to that in FIG. 8.

In this case, the operating member 11 is inverted vertically and the coupling 36 is arranged on a left side of FIG. 9 and opposite to the side when the operating member 11 is moved along the first movement path with respect to the housing 10. First, the operating member 11 is assembled at the assembled position. At the assembled position, the lock projection 27 of the second lock 26 is inserted into the guide groove 46 of the arm 37 and comes into contact with the front end part of the guide groove 46, thereby restricting a rotational displacement of the operating member 11 in the direction opposite to that toward the initial position.

Subsequently, the operating member 11 is rotated counterclockwise about the support shafts 18 from the assembled position toward the initial position. When the operating member 11 reaches the initial position, the lock projection 27 of the second lock 26 is inserted resiliently into the other end 43 of the long groove 39 from inside and the engaging edge 44 of the long groove 39 contacts the lock projection 27 from the front to restrict a return displacement of the operating member 11 to the assembled position. Further, the plate of the arm 37 on the other side (side where the resilient piece 48 is not provided) is stopped in contact with the rear end of the stopper 35, thereby restricting any further rotation of the operating member 11 beyond the initial position (see FIG. 9). Furthermore, the locking projection 49 of the resilient piece 48 locks the lock receiving portion 32, thereby restricting a movement of the operating member 11 to the connection position. In this case, the locking projection 49 locks the lock receiving portion 32 on the lower surface (surface where the resilient locks 25, 26 are not provided) of the housing 10 on a side opposite to that when the first movement path is selected. Further, the stopper 35 to be stopped in contact with the arm 37 at the initial position is provided on the lower surface of the housing 10 when the first movement path is selected while being provided on the upper surface of the housing 10 when the second movement path is selected.

Subsequently, the housings 10, 12 are connected shallowly and the cam followers 14 are inserted into the entrances of the cam grooves 38. The resilient piece 48 then is pressed by the unlocking portion 15 and deflected rearwardly to move away from the lock receiving portion 32, thereby enabling the operating member 11 to be moved to the connection position. Subsequently, the operating member 11 is moved linearly toward the connection position (side where the first lock portion 25 is located) along the second movement path. When the operating member 11 reaches the connection position, the lock projection 27 of the first lock 25 is inserted resiliently into the end 41 of the long groove 39 from inside and contacts the end 41 of the long groove 39 in a direction opposite to the return direction to the initial position, thereby restricting a return movement of the operating member 11 to the initial position (see FIG. 10). Further, the lock projection 27 of the second lock 26 is inserted into the escaping groove 47 of the arm 37 and allowed to escape.

As just described, roles of locking functions of the first and second locks 25, 26 at each of the initial position and the connection position are reversed when the operating member 11 is moved along the first movement path and when the operating member 11 is moved along the second movement path, but the locking functions themselves are the same.

As described above, each of the following effects can be achieved according to this embodiment.

Since the operating member 11 is rotated from the assembled position to the initial position and the laterally projecting amount of the housing 10 is suppressed at the assembled position than at the initial position, the operating member 11 is less likely to interfere with external matter intruding to a lateral side of the housing 10 at the assembled position. However, a transition is made from the rotating operation by the rotating mechanism to the linearly moving operation by the sliding mechanism at the initial position. Therefore, the operating member 11 does not stay long at the initial position and is less likely to interfere with external matter at the initial position. As a result, it is possible to prevent a situation in which the operating member 11 is moved inadvertently from the initial position to the connection position or broken due to interference with external matter.

Further, the arms 37 of the operating member 11 are not covered from outside by members, such as conventional covers. However, the expanding movements are suppressed by contact of the engaging edges 44 of the long grooves 39 with the jaws 19 of the support shafts 18 to prevent detachment from the housing 10. Omitting the conventional covers avoids enlargement of the housing 10. This is ensured by the arrangement of the operating member 11 in a state exposed on the outer surfaces without being covered by the housing 10.

Further, the operating member 11 is moved linearly from the initial position to the connection position and one of the first and second movement paths can be selected depending on an installation situation and usefulness is enhanced. In addition, the locking means for keeping the operating member 11 at the initial position and the connection position are realized by the first lock 25 and the second lock 26, and four locking means corresponding to each movement path and each position are not provided. Thus, a structure can be simplified. In this case members such as the conventional covers configured to cover the operating member 11 are not present on the outer surfaces of the housing 10, and a mold removal structure in molding the first and second locks 25, 26 on the outer surface of the housing 10 needs not be complicated.

When the operating member 11 is moved linearly with respect to the housing 10, the engaging edges 44 of the long grooves 39 slide in contact with the support shafts 18 to guide a movement of the operating member 11. The long grooves 39 guide a movement of the operating member 11, restrict a movement of the operating member 11 by being locked by the resilient locks 25, 26 and suppress the opening deformation of the operating member 11 by causing the jaws 19 of the support shafts 18 to contact the engaging edges 44. Thus, as compared to the case where each function is individually provided, the structure of the operating member 11 can be simplified.

The resilient lock 25, 26 restricts a displacement of the operating member 11 in the direction opposite to that from the assembled position toward the initial position by locking the lock projection 27 to the front end of the guide groove 46 when the operating member 11 is at the assembled position and restricts a displacement of the operating member 11 in the return direction from the initial position to the assembled position by locking the lock projection 27 to the other end 43 of the long groove 39 when the operating member 11 is at the initial position. Thus, the operating member 11 is locked and held to the resilient lock 25, 26 both at the initial position and at the assembled position and it is not necessary to provide the locking structure for each of the initial position and the assembled position. Therefore, the structure can be simplified.

Further, the unlocking portion 15 of the mating housing 12 presses the resilient piece 48 when the operating member 11 is at the initial position so that the resilient piece 48 is deflected and deformed in the direction along the plate surface of the arm 37 to be unlocked from the lock receiving portion 32 and the operating member 11 is in a state displaceable toward the connection position. In this case, a locking margin of the resilient piece 48 to the lock receiving portion 32 is determined in the direction along the plate surface of the arm 37. Thus, a degree of freedom in setting the locking margin is high and a sufficiently large locking margin can be set. As a result, the locking strength of the operating member 11 at the initial position can be enhanced.

Further, the resilient piece 48 is a beam supported on both ends coupled to the body of the arm 37. Therefore, external matter, such as a looped wire is less likely to be caught by the arm 37 and the deflection strength of the arm 37 can be enhanced.

The lock receiving portions 32 to be locked by the resilient piece 48 are provided on the outer surfaces of the housing 10 and members such as the conventional covers are not present on the outer surfaces of the housing 10. Accordingly, a mold removal structure in molding the lock receiving portions 32 needs not be complicated.

Other embodiments are described below.

Contrary to the above embodiment, the support shafts may be provided on the inner surfaces of the arms of the operating member, the long grooves may be be open in the outer surfaces of the housing and the support shafts may be inserted into the long grooves from outside to be slidable in contact with the long grooves.

The long grooves may have a bottomed shape.

The shape and the number of the jaws on the support shaft are arbitrary and the escaping recesses may be provided to correspond to the jaw portions.

The housing may include a wire cover to cover the rear surface of the housing when the wires connected to the terminal fittings are pulled out rearwardly of the housing. Thus, the support shafts, the lock receiving portions and the resilient locks may be provided on the wire cover.

LIST OF REFERENCE SIGNS

10 . . . housing
11 . . . operating member
12 . . . mating housing
15 . . . unlocking portion
18 . . . support shaft
19 . . . jaw
25 . . . first lock
26 . . . second lock
27 . . . lock projection
32 . . . lock receiving portion
36 . . . coupling
37 . . . arm
38 . . . cam groove
39 . . . long groove
41 . . . end of long groove
44 . . . engaging edge portion
46 . . . guide groove
48 . . . resilient piece
49 . . . locking projection

What is claimed is:

1. A connector, comprising:

a housing connectable to a mating housing;

an operating member that is linearly movable along the housing between an initial position and a connection position and being configured to proceed with a connecting operation of the housing and the mating housing by cam engagement with the mating housing as the operating member is displaced from the initial position to the connection position, a moving direction of the operating member from the initial position toward the connection position with respect to the housing is selectable from those along a first movement path and a second movement path opposite to each other;

a first lock and a second lock paired at line-symmetrical positions with respect to a center of a length of the housing along the moving direction of the operating member;

the first lock resiliently locks the operating member at the initial position and the second lock resiliently locks the operating member at the connection position when the operating member moves along the first movement path; and the second lock resiliently locks the operating member at the initial position and the first lock resiliently locks the operating member at the connection position when the operating member moves along the second movement path.

* * * * *